US005221032A

United States Patent [19]

Bott et al.

[11] Patent Number: 5,221,032

[45] Date of Patent: Jun. 22, 1993

[54] TORSO-MOUNTED HOLDER TRAY ASSEMBLY

[76] Inventors: Glenn R. Bott, 22 Hewlett Rd., Towaco, N.J. 07082; Michael J. Dillon, 404 Green St., Boonton, N.J. 07005

[21] Appl. No.: 760,407

[22] Filed: Sep. 16, 1991

[51] Int. Cl.[5] ..... A45F 5/04

[52] U.S. Cl. ..... 224/270; 224/226; 224/242; 108/43; 206/565

[58] Field of Search ..... 224/224, 225, 226, 233, 224/242, 249, 270, 901; 108/43; 2/49 A; 297/149, 151; 206/546, 549, 560, 565; 220/23.83

[56] References Cited

U.S. PATENT DOCUMENTS

| | | | |
|---|---|---|---|
| 2,304,705 | 12/1942 | Pate | 224/270 X |
| 2,510,646 | 6/1950 | Meers | 224/270 X |
| 3,009,613 | 11/1961 | Noland | 224/270 X |
| 3,090,330 | 5/1963 | Best . | |
| 3,125,825 | 3/1964 | Gaudette . | |
| 3,541,976 | 11/1970 | Rozas . | |
| 3,656,681 | 4/1972 | Goings | 206/546 X |
| 4,607,758 | 8/1986 | Stevens | 220/23.83 |
| 4,634,032 | 1/1987 | LaFlame | 224/265 |
| 4,715,293 | 12/1987 | Cobbs . | |
| 4,807,928 | 2/1989 | Cone | 297/151 X |
| 4,968,092 | 11/1990 | Giambrone | 297/151 |
| 4,988,024 | 1/1991 | Weber | 224/270 X |
| 4,989,742 | 2/1991 | Powell | 206/549 X |
| 5,052,603 | 10/1991 | Spina | 224/270 |
| 5,067,643 | 11/1991 | McKinney | 224/226 X |
| 5,074,222 | 12/1991 | Welch | 224/265 X |

*Primary Examiner*—Allan N. Shoap
*Assistant Examiner*—Christopher J. McDonald
*Attorney, Agent, or Firm*—John R. Flanagan

[57] ABSTRACT

A holder tray assembly for mounting on a torso of a wearer includes a tray capable of supporting objects and a pair of laterally-spaced apart support rods. Each rod has a pair of vertical and horizontal leg portions, the vertical leg portions for resting against the front torso area of a wearer, the horizontal leg portions projecting outwardly from the vertical leg portions and supporting the tray in a substantially horizontal plane and forwardly of a front side of the wearer's torso. The holder tray assembly also has a transverse support member extending between and attached to the vertical leg portions of the rods and a flexible member for encircling a back side of the wearer's torso and being attached at one end to the transverse support member. The support member and flexible member also includes strips of complementary hook and loop materials for detachably attaching the flexible member at an opposite end portion thereof to the support member for securing the holder tray assembly to the front area of the user's torso.

20 Claims, 2 Drawing Sheets

TORSO-MOUNTED HOLDER TRAY ASSEMBLY

BACKGROUND OF THE INVENTION

1. Field of the Invention

The present invention generally relates to the serving of food and drink at parties and gatherings and, more particularly, is concerned with a torso-mounted tray assembly for holding food and drink.

2. Description of the Prior Art

Backyard barbecues and social events seldom have sufficient seating available for everyone in attendance. Oftentimes at such gatherings a person may have to make a plate of food not only for oneself, but also for a spouse or child. Needless to say, one person cannot accomplish this task at a given time with just two hands. If an attempt is made to balance two plates with one hand and fill them with the other, frequently accidental spills result which cause messes and embarrassment. As a result, the person will typically make the plate of food for the spouse or child, deliver the filled plate, and then have to go back and wait in line to make one's own plate of food.

Portable desks and tables worn at the front of a person's torso for holding a variety of objects, such as cameras, food, writing materials and the like, are known in the prior art. Representative examples of prior art torso-mounted desks and tables are disclosed in U.S. Pat. No. 3,090,330 to Best, U.S. Pat. No. 3,125,825 to Gaudette, U.S. Pat. No. 3,541,976 to Rozas, and U.S. Pat. No. 4,715,293 to Cobbs. While all of these prior art devices may function reasonably well under the limited range of conditions for which they were designed, each device appears to embody one or more drawbacks which makes it less than an optimum design for the intended uses and for avoiding the above-described problems. For instance, the prior art devices of Best, Rozas and Cobbs appear to be too heavy, bulky and overly complicated to be useful. Conversely, the prior art device of Gaudette appears to be too flimsy to serve the intended purpose of supporting objects.

Consequently, a need exists for a holding device which will alleviate the above-mentioned problems and still be appropriately designed for the intended uses.

SUMMARY OF THE INVENTION

The present invention provides a holder tray assembly designed to satisfy the aforementioned needs. The holder tray assembly of the present invention enables one person to make more than one plate of food and gather more than one drink at a given time. Both hands of the person are free to deliver food and drink from a serving buffet to the tray assembly.

The holder tray assembly of the present invention is not merely limited to use in making plates of food or as as drink holder. It can be used in many other situations, for example, as an artist's palate or easel, as a mobile desk, or as a serving tray to be worn by a waitress or waiter in a restaurant or bar.

Accordingly, the present invention is directed to a holder tray assembly for mounting on a torso of a wearer. The holder tray assembly comprises: (a) a tray capable of supporting objects; (b) a pair of spaced support rods, each rod having a pair of vertical and horizontal leg portions, the vertical legs for resting against the front torso area of a wearer, the horizontal leg portions projecting outwardly from the vertical leg portions and supporting the tray in a substantially horizontal plane and forwardly of a front side of the wearer's torso; (c) a transverse support member extending between and attached to the vertical leg portions of the rods; (d) a flexible member for encircling a back side of the wearer s torso and being attached at one end to the transverse support member; and (e) means for detachably attaching the flexible member at an opposite end portion thereof to the support member for securing the holder tray assembly to the front area of the user's torso.

More particularly, the tray includes a main panel having a peripheral rim encompassing the main panel and extending above the main panel. Also, the main panel of the tray has a central area surrounded by an outwardly and upwardly inclined interior rim configured to support a plate for holding food. The main panel of the tray also includes at least one cylindrical holder cup extending above and below the main panel for holding a drinking glass and at least one clip defining a wedge-shaped cavity between the clip and the main panel for holding a napkin.

Further, the support rods are laterally spaced apart from one another and extend substantially parallel to one another. The tray includes a plurality of lugs attached to an underside thereof and having holes through the lugs through which extends the horizontal leg portions of the support rods. The upper ends of the vertical leg portions of the support rods extend within opposite ends of the support member.

Additionally, the flexible securing member is an elongated strap attached at one end to one end of the support member. The attaching means is a pair of strips of complementary hook and loop fastening materials detachably attachable together. The strips are applied respectively along a front of the support member and along the opposite end portion of the flexible strap.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
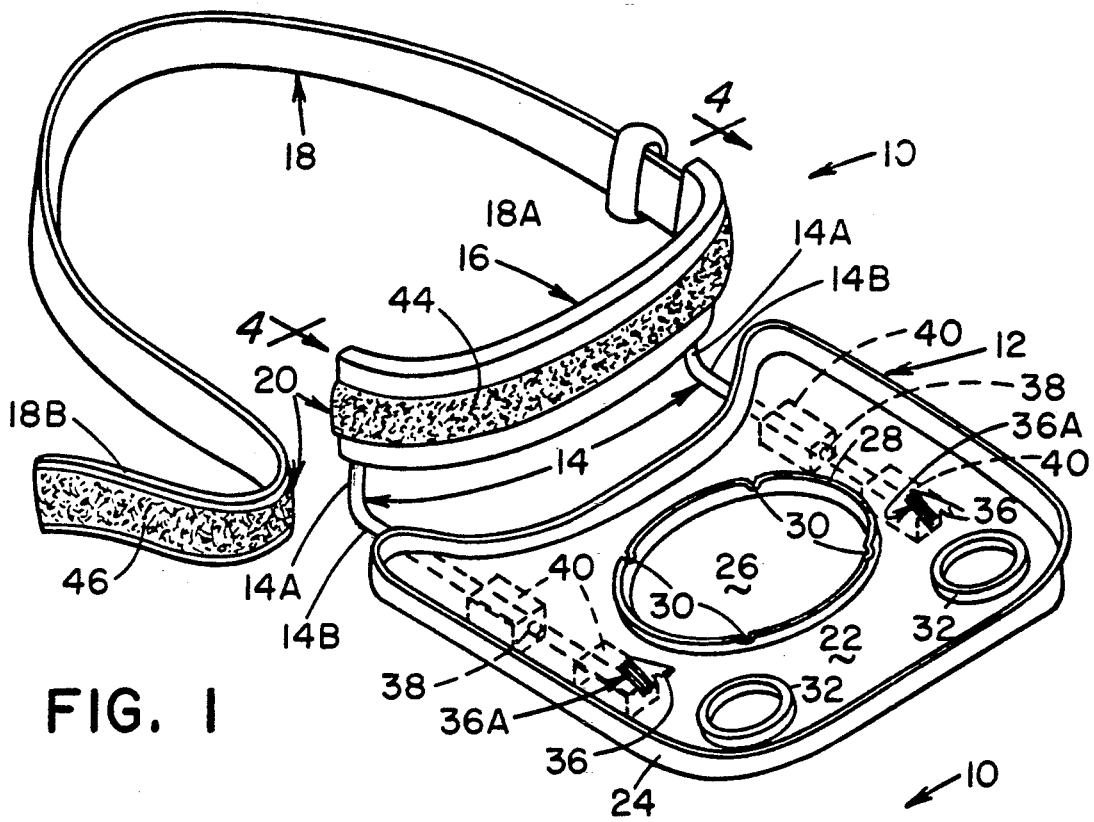
FIG. 1 is a perspective view of a torso-mounted holder tray assembly of the present invention.
Figure 2:
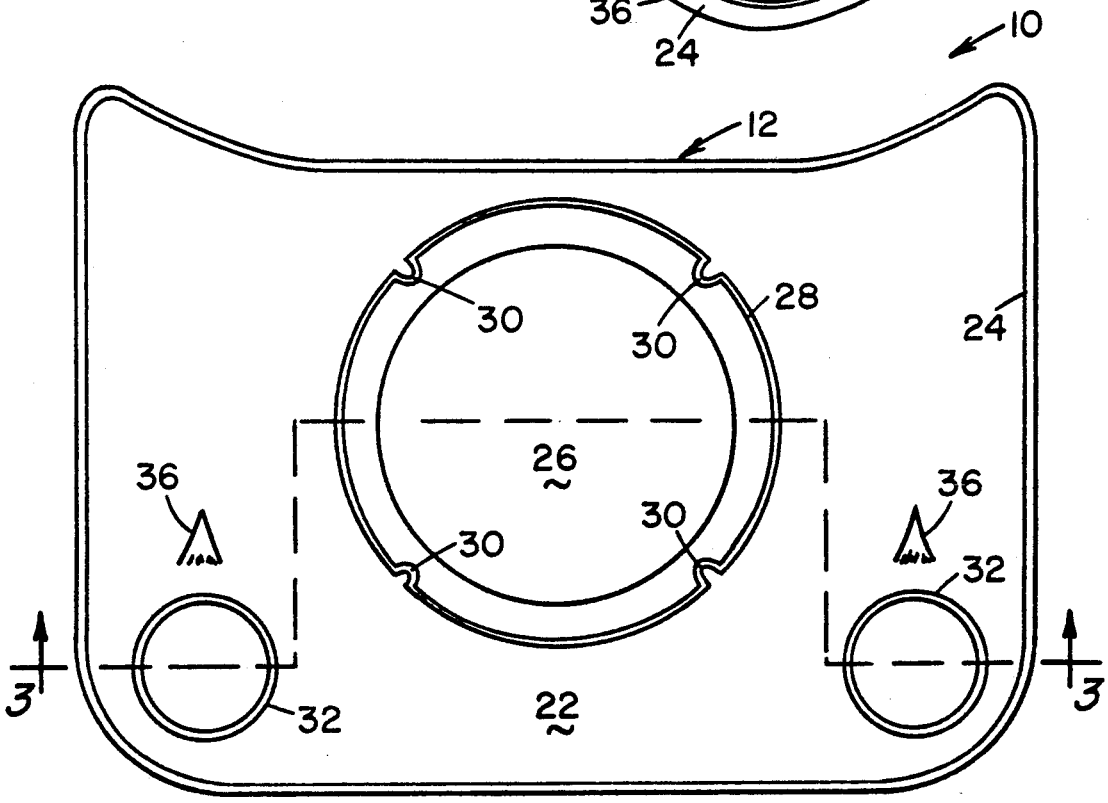
FIG. 2 is an enlarged fragmentary top plan view of the holder tray assembly of FIG. 1.
Figure 4:
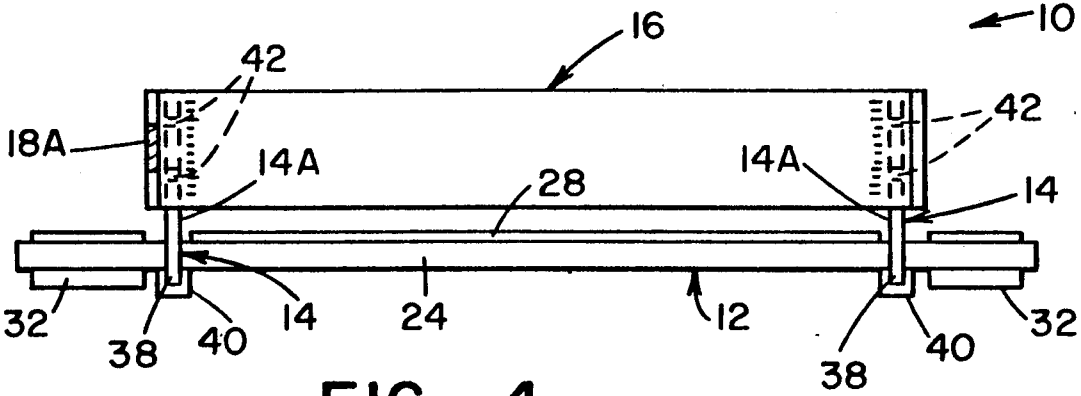
FIG. 4 is an enlarged rear elevational view of the holder tray assembly as seen along line 4—4 of FIG. 1.

Referring to the FIGS. 1 through 4 of the drawings, there is illustrated a holder tray assembly, generally designated 10, of the present invention for mounting on a torso (not shown) of a wearer. The holder tray assembly 10 basically includes a tray 12 capable of supporting objects, a pair of laterally-spaced apart support rods 14, a transverse support member 16, a flexible securing member 18, and means 20 for detachably attaching a free end portion of the securing member 18 to the support member 16.

Figure 3:
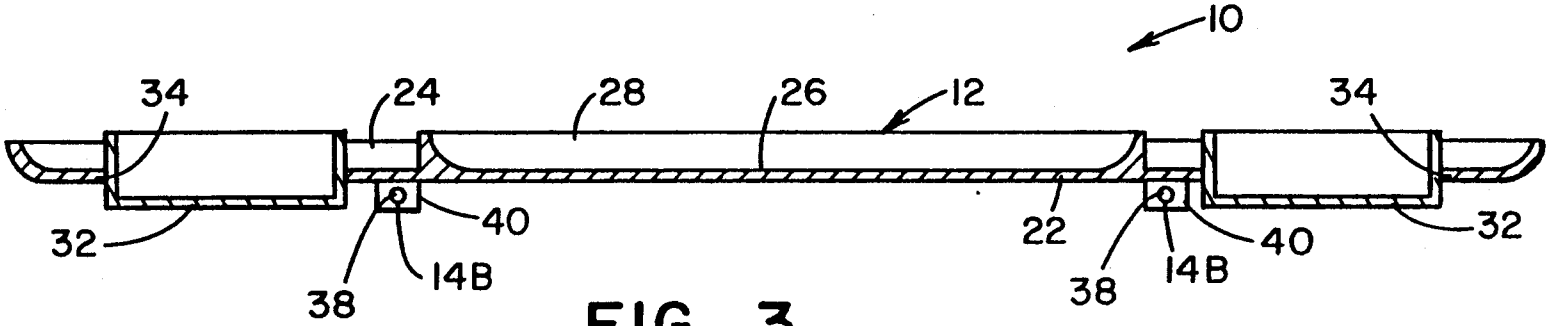
FIG. 3 is an enlarged sectional view of the holder tray assembly taken along line 3—3 of FIG. 2.

More particularly, the tray 12 of the assembly 10 includes a main panel 22 having a peripheral rim 24 encompassing the tray panel 22. The peripheral rim 24 has an upwardly and outwardly inclined orientation in cross-section, as best shown in FIG. 3. The main panel 22 and peripheral rim 24 together have an overall rectangular configuration wherein the peripheral rim 24 is defined by relatively straight sides and rounded corners, except for along the rear side of the tray 12. The main panel 22 and peripheral rim 24 have a generally curved recessed configuration at the rear side of the tray 12 for conforming with the shape of the front of the wearer's torso.

The main panel 22 of the tray 12 has a central location or area 26 surrounded by an outwardly and upwardly inclined interior rim 28 connected on the panel 22. The area 26 and interior rim 28 are thus configured to support a plate for holding food, such as a paper plate. At a plurality of locations circumferentially spaced from one another about the interior rim 28, the rim 28 contains a plurality of radially-inwardly projecting protrusions 30 which serve as a plurality of snap-in features for retaining a flexible plate in a seated position on the area 26 of the tray 12.

Also, the tray 12 includes a pair of beverage container holders 32 located adjacent forward corners of the tray 12. The holders 32 are in the form of cylindrical cups extending through holes 34 in the tray 12. The holders 32 extend both above and below the main panel 22 of the tray 12. The circular configurations of the cup-shaped holders 32 adapted them to receive and seat a wide variety of configurations of glasses for containing a drink. As an option, a conventional ashtray can be mounted to one of the circular holders 32.

Rearwardly of the cylindrical holders 32, the tray 12 also includes a pair of clips 36 defining a wedge-shaped cavity 36A between the clips 36 and the main panel 22 for holding napkins. The clips 36 have triangular shapes with the base of the clips 36 being integrally attached to and merging from the main panel 22 of the tray 12.

The support rods 14 of the assembly 10 support the tray 12 and, in turn, are supported from the transverse support member 16. The support rods 14 are laterally spaced apart from one another and extend substantially parallel to one another. Each rod 14 has a pair of vertical and horizontal leg portions 14A, 14B integrally connected to one another and together having a right angle configuration. The vertical leg portions 14A will rest against the front torso area of a wearer when the assembly is worn by the wearer. The horizontal leg portions 14B project outwardly from the respective vertical leg portions 14A and will support the tray 12 in a generally horizontal plane extending forwardly of the front side of the wearer's torso when the vertical leg portions 14A are held against the front torso side.

The horizontal leg portions 14B of the support rods 14 support the tray 12 by being received through circular holes 38 of right and left aligned pairs of lugs 40 attached to the underside of the main panel 22 of the tray 12. The forward ends of the horizontal leg portions 14B can be permanently attached to the lugs 40. As an alternative, the horizontal leg portions 14B can be frictionally interfitted with the lugs 40 such that the tray 12 can be removed from the support rods 14 to facilitate easier cleaning of the tray 12.

The transverse support member 16 of the assembly 10 extends between the upper ends of the vertical leg portions 14A of the support rods 14. The support member 16 has an arcuate shape generally matching that of the rear side of the main panel 22 and peripheral rim 24 of the tray 12 for conforming with the shape of the front of the wearer's torso. The upper ends of the vertical leg portions 14A preferably extend within the opposite ends of the support member 16. The support member 16 is preferably fabricated by molding it from a suitable plastic material. The opposite ends of the support member 16 are molded about the upper ends of the vertical leg portions 14A which each have several spaced flat areas 42 serving to lock the support member 16 on the vertical leg portions 14A of the support rods 14.

The flexible securing member 18 of the assembly 10 preferably takes the form of an elongated flexible strap. The flexible member 18 is permanently attached at one end 18A to the one end of the support member 16. When the assembly 10 is mounted to the torso of the wearer, the flexible member 18 encircles the back side of the wearer's torso. The attaching means 20 of the assembly 10 functions to detachably attach the opposite free end portion 18B of the flexible member 18 to the support member 16.

Preferably, the attaching means 20 takes the form of a pair of strips 44, 46 of complementary hook and loop fastening materials detachably attachable together and being applied respectively along the front of the support member 16 and along the opposite free end portion 18B of the flexible member or strap 18. The complementary hook and loop materials 44, 46 can be that commonly known as Velcro (a trademark owned by Velcro U.S.A., Inc.).

By way of example, the tray 12 can be fabricated from a suitable plastic material such as polyethelene. The support rods 14 can be fabricated from a suitable metal such as steel or aluminum and can be ¼ inch in diameter. The support rods 14 also can be fabricated from a rigid plastic material. The holes 38 of the lugs 40 which receive the horizontal leg portions 14B of the support rods 14 can be 17/64 inch in diameter. The tray 12 can be approximately twelve inches from front-to-back and sixteen inches from side-to-side. It should be apparent that the holder tray assembly 10 of the present invention is not limited to any particular types of materials used in its construction.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

Having thus described the invention, what is claimed is:

1. A holder tray assembly for mounting on a torso of a wearer, said holder tray assembly comprising:

(a) a tray capable of supporting objects;

(b) means for supporting said tray having a pair of vertical and horizontal portions, said vertical portion for resting against the front torso area of a wearer, said horizontal portion projecting outwardly from said vertical portion and supporting said tray in a substantially horizontal plane and forwardly of a front side of the wearer's torso;

(c) a transverse support member attached to said vertical portion of said tray supporting means and spaced above said tray and above said horizontal portion of said tray supporting means;

(d) a flexible securing member for encircling a back side of the wearer's torso, said flexible securing member being an elongated flexible strap attached at one end to one end of said transverse support member; and (e) means for detachably attaching said flexible strap at an opposite free end portion thereof to said transverse support member for securing said holder tray assembly to the front area of the user's torso, said attaching means including complementary fastening means detachably attachable together and being applied to said opposite end portion of said strap and at least to an opposite end of said transverse support member.

2. The assembly of claim 1 wherein said tray includes a main panel having a peripheral rim encompassing said main panel and extending above said main panel.

3. The assembly of claim 2 wherein said main panel of said tray has a central area surrounded by an outwardly and upwardly inclined interior rim configured to support a plate for holding food.

4. The assembly of claim 3 wherein said interior rim includes a plurality of radially-inwardly projecting protrusions defined at circumferentially spaced locations about said interior rim which provide a plurality of snap-in features for retaining a flexible plate in a seated position on said central area of said tray.

5. The assembly of claim 1 wherein said tray-supporting means is a pair of spaced support rods being laterally spaced apart from one another and extending substantially parallel to one another, said pair of vertical and horizontal portions of said tray-supporting means being pairs of vertical and horizontal leg portions of said respective rods.

6. The assembly of claim 5 wherein:

said tray includes a plurality of lugs attached to an underside of said tray and having holes therethrough; and said horizontal leg portions of said support rods extending through said holes of said lugs.

7. The assembly of claim 5 wherein upper ends of said vertical leg portions of said support rods extend within opposite ends of said support member.

8. The assembly of claim 1 wherein said complementary fastening means of said attaching means is a pair of strips of complementary hook and loop fastening materials detachably attachable together and being applied respectively along said opposite end and a front of said support member and along said opposite free end portion of said flexible strap.

9. A holder tray assembly for mounting on a torso of a wearer, said holder tray assembly comprising:

(a) a tray capable of supporting objects;

(b) a pair of spaced support rods laterally spaced apart from one another and extending substantially parallel to each other, each rod having a pair of vertical and horizontal leg portions, said vertical legs for resting against the front torso area of a wearer, said horizontal leg portions projecting outwardly from said vertical leg portions and supporting said tray in a substantially horizontal plane and forwardly of a front side of the wearer's torso;

(c) said tray including a plurality of lugs attached to an underside of said tray, said lugs having respective holes defined therethrough which receive said horizontal leg portions of said support rods;

(d) a transverse support member extending between and attached to said vertical leg portions of said rods;

(e) a flexible securing member for encircling a back side of the wearer's torso and being attached at one end to said transverse support member, said flexible securing member being an elongated flexible strap attached at one end to one end of said transverse support member; and (f) means for detachably attaching said flexible strap at an opposite end portion thereof to said transverse support member for securing said holder tray assembly to the front area of the user's torso, said attaching means being a pair of strips of complementary hook and loop fastening materials detachably attachable together and being applied respectively along a front of said transverse support member and along an opposite free end portion of said flexible strap.

10. The assembly of claim 9 wherein said tray includes a main panel having a peripheral rim encompassing said main panel and extending above said main panel.

11. The assembly of claim 10 wherein said main panel of said tray has a central area surrounded by an outwardly and upwardly inclined interior rim configured to support a plate for holding food.

12. The assembly of claim 11 wherein said interior rim includes a plurality of radially-inwardly projecting protrusions defined at circumferentially spaced locations about said interior rim which provide a plurality of snap-in features for retaining a flexible plate in a seated position on said central area of said tray.

13. The assembly of claim 10 wherein said main panel of said tray includes at least one holder cup extending above and below said main panel.

14. The assembly of claim 10 wherein said main panel of said tray includes at least one clip defining a wedge-shaped cavity between said clip and said main panel for holding a napkin.

15. The assembly of claim 14 wherein said clip has a triangular shape with a base being integrally attached to and merging from said main panel of said tray.

16. The assembly of claim 9 wherein upper ends of said vertical leg portions of said support rods extend within opposite ends of said support member.

17. A holder tray assembly for mounting on a torso of a wearer, said holder tray assembly comprising:

(a) a tray having a main panel capable of supporting objects, said main panel having a peripheral rim encompassing said main panel and extending above said main panel, said main panel also having a central area surrounded by an outwardly and upwardly inclined interior rim configured to support a plate for holding food, said interior rim having a plurality of radially-inwardly projecting protrusions defined at circumferentially spaced locations about said interior rim which provide a plurality of snap-in features for retaining a plate in a seated position on said central area of said tray;

(b) means for supporting said tray having a pair of vertical and horizontal portions, said vertical portion for resting against the front torso area of a wearer, said horizontal portion projecting outwardly from said vertical portion and supporting said tray in a substantially horizontal plane and forwardly of a front side of the wearer's torso;

(c) a transverse support member attached to said vertical portion of said tray supporting means;

(d) a flexible securing member for encircling a back side of the wearer's torso and being attached at one end to said transverse support member; and (e) means for detachably attaching said flexible member at an opposite end portion thereof to said support member for securing said holder tray assembly to the front area of the user's torso.

18. The assembly of claim 17 wherein said main panel of said tray includes at least one holder cup extending above and below said main panel.

19. The assembly of claim 17 wherein said main panel of said tray includes at least one clip defining a wedge-shaped cavity between said clip and said main panel for holding a napkin.

20. The assembly of claim 17 wherein said clip has a triangular shape with a base being integrally attached to and merging from said main panel of said tray.

* * * * *